United States Patent [19]

Long

[11] Patent Number: 4,651,983

[45] Date of Patent: Mar. 24, 1987

[54] CARD FEEDER CONTROL

[75] Inventor: John A. Long, Scarborough, Canada

[73] Assignee: Longford Equipment International Limited, Scarborough, Canada

[21] Appl. No.: 634,820

[22] Filed: Jul. 26, 1984

Related U.S. Application Data

[63] Continuation-in-part of Ser. No. 455,032, Jan. 3, 1983.

[30] Foreign Application Priority Data

Dec. 15, 1983 [CA] Canada ..... 443379

[51] Int. Cl.[4] ..... B65H 3/04

[52] U.S. Cl. ..... 271/35; 271/110; 271/114; 271/125; 271/31.1

[58] Field of Search ..... 271/35, 110, 111, 114, 271/121, 125, 166, 167, 31.1

[56] References Cited

U.S. PATENT DOCUMENTS

| | | | |
|---|---|---|---|
| 1,074,221 | 9/1913 | Stickney | 271/35 |
| 2,979,330 | 4/1961 | Weber | 271/114 |
| 2,988,355 | 6/1961 | Rabinow | 271/150 X |
| 3,285,389 | 11/1966 | Kaplan | 271/150 X |
| 3,486,749 | 12/1969 | Billings | 271/114 X |
| 3,705,719 | 12/1972 | Polit | 271/3 |
| 3,754,754 | 8/1973 | Peterson . | |
| 3,908,983 | 9/1975 | Long | 271/125 X |
| 3,988,017 | 10/1976 | Kyhl | 271/111 |
| 4,039,180 | 8/1977 | Stocker | 271/121 X |
| 4,171,130 | 10/1979 | Jeschke | 271/111 X |
| 4,444,385 | 4/1984 | Berry | 271/114 X |

FOREIGN PATENT DOCUMENTS

| | | |
|---|---|---|
| 2348386 | 5/1974 | Fed. Rep. of Germany . |
| 3048036 | 9/1981 | Fed. Rep. of Germany . |

*Primary Examiner*—Richard A. Schacher

[57] ABSTRACT

A method and a device for controlling the issuance of cards or like paper stock singly from a card feeder having a friction wheel which is positioned above a movable platform to feed the cards singly from the bottom of a stock. The friction wheel is rotated sequentially through preselectable arcs, intermittently if desired, whereby the issuing cards are optimally spaced apart. An auxiliary feed mechanism operating at a preselected speed and intermittently if desired may assist feeding the bottom cards of the stack as they are moved towards the nip between the friction wheel and the feeder platform. An advancer mechanism may assist movement of the stack towards the feeder platform, the stack advancer being movable sequentially at a preselected amount and preferably intermittently.

14 Claims, 9 Drawing Figures

CARD FEEDER CONTROL

STATEMENT OF PRIOR ART

The most relevant prior art known to the applicant is as follows:

U.S. Pat. No. 1,214,474, Jones
U.S. Pat. No. 1,637,833, Mueller
U.S. Pat. No. RE 15,293, La Bombard
U.S. Pat. No. 2,343,479, Ryan et al
U.S. Pat. No. 3,705,719, Polit et al
U.S. Pat. No. 3,908,983, Long
U.S. Pat. No. 3,988,017, Kyhl
U.S. Pat. No. 4,171,130, Jeschke
U.S. Pat. No. 4,039,180, Stocker
United Kingdom Patent No. 1,491,491 Long

FIELD OF THE INVENTION

This invention relates to a method and apparatus for feeding cards or like paper stock singly from a stack onto a movable conveyor system.

BACKGROUND OF THE INVENTION

In my U.S. Pat. No. 3,908,983, issued Sept. 30, 1975 I describe a device for feeding single blank cards at high speed into a machine for scoring, folding, stacking or otherwise handling such cards. In the operation of that device a stack of cards is placed between a guide bar and a retainer plate which hold the stack sloping downwardly in a forward direction with the lower cards of the stack being fanned forwardly above an endless belt. As the belt moves, the lowest card of the stack is drawn through the gap between the belt and a friction wheel which rotates slowly to allow the cards to move singly through the gap. The belt and friction wheel are driven by the same motor with suitable gear reduction.

The problem with such a device is that thicker cards tend to pass too slowly from the stack, creating larger gaps between cards issuing from the feeder which slows production, while thinner cards tend to pass too freely from the stack and shingle up after issuing from the feeder. The texture of the cards also influences their rate of passage through the feeder.

It is an object of the present invention to provide a card feeder of the type described in which the rate of issuance of cards is controlled notwithstanding their thickness or texture.

SUMMARY OF THE INVENTION

Essentially the invention consists of a method of feeding cards or like paper stock singly from a stack thereof, using a friction wheel positioned above a movable platform to feed the cards singly from the bottom of the stack forwardly onto the platform from the stack and to pass the cards singly through a gap between the friction wheel and the platform to issue therefrom, the step of: rotating the friction wheel sequentially through preselectable arcs whereby the issuing cards are optimally spaced apart.

In another aspect the invention resides in a device for feeding cards and like paper stock singly from a stack thereof, in which a friction wheel is positioned above a movable platform and the cards are fed singly from the bottom of the stack through a gap between the friction wheel and the platform to issue therefrom: a stepping motor connected to drive the friction wheel; and means connected with the stepping motor to control the rotation of the friction wheel sequentially through preselectable arcs whereby the issuing cards are optimally spaced apart.

In still another aspect the invention resides in a method and a device as defined above, including a stack advancer used to move the stack towards the movable platform, the stack advancer being moved sequentially a preselectable amount, preferably intermittently, whereby the pressure of the stack against the platform is substantially constant.

In yet another aspect of the invention an auxiliary feeder is provided for the method and device as defined above, the auxiliary feeder being advanced a preselectable amount and preferably intermittently.

BRIEF DESCRIPTION OF THE DRAWINGS

An example embodiment of the invention is shown in the accompanying drawings in which.

DESCRIPTION OF PREFERRED EMBODIMENT

Figure 1:
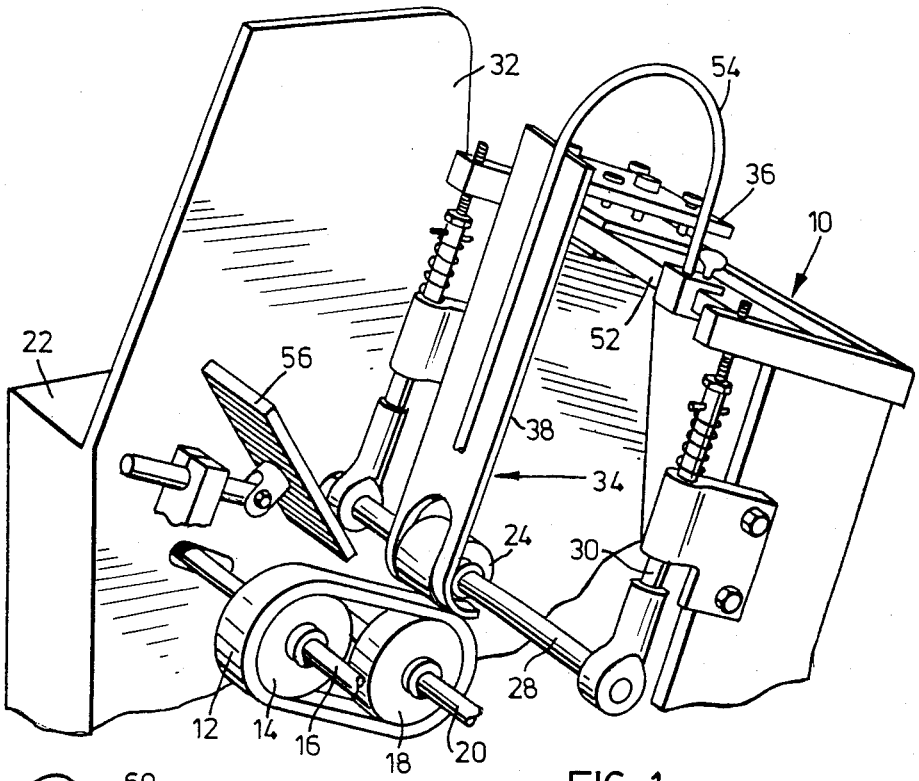
FIG. 1 is a perspective view of a card feeder.

The example embodiment shown in the drawings consists of a feeder 10 which is mounted above a conveyor (not shown), the feeder being described in my aforementioned U.S. Pat. No. 3,908,893. Feeder 10 comprises a movable feeder platform in the form of an endless belt 12 carried by an idler wheel 14 rotatably mounted on a shaft 16 and a drive wheel 18 keyed on a drive shaft 20. Both shafts 16 and 20 are journally mounted on a frame 22 and drive shaft 20 is suitably connected with drive means (not shown). A friction wheel 24 is mounted immediately above drive wheel 18, wheel 24 being keyed on a drive shaft 28 which is journally mounted in a pair of bearing shafts 30 adjustably fixed on frame 22. Belt 12 and friction wheel 24 are positioned between a pair of spaced upright side walls 32 (only one of which is shown in FIG. 1) mounted on frame 22.

A curver guide bar 34, mounted on a forwardly projecting plate 36, is located above belt 12. The upper portion of guide bar 34 forms an arm 38 sloping downwardly and rearwardly and the guide bar curves in its lower portion in an arc 40 to form a forwardly projecting tongue 42 spaced from belt 12 to define a passage (see FIG. 2). Friction wheel 24 is located in a slot 46 in arc 40 of guide bar 34 and is so positioned that its rim 48 extends downwardly slightly below the lower surface of tongue 42 but does not extend laterally beyond the rearward surface of arm 38 or arc 40, i.e. only the lower portion of friction wheel 24 is exposed below guide bar 34. A gap 50 is formed between the lowest point of rim 48 and belt 12.

Rim 48 of friction wheel 24 is of hard rubber, or other material such as a tungsten carbide coating on steel, of a high coefficient of friction.

As seen in FIG. 1, plate 36 of guide bar 34 is adjustably mounted on a pair of crossbars 52 on frame 24 which also carry a slidable lateral guide rod 54 for bearing laterally against a stack of cards. An adjustable retainer plate 56, spaced behind guide bar 34, is mounted on a further crossbar (not shown) on frame 22.

Figure 4:
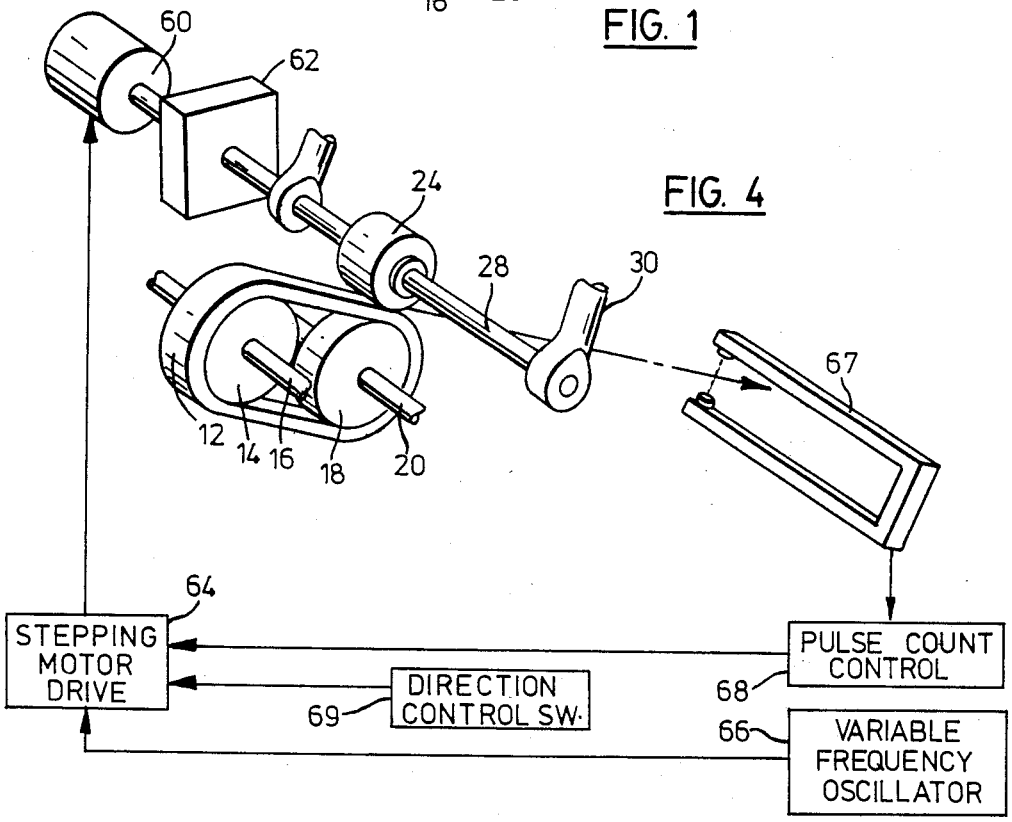
FIG. 4 is a schematic diagram showing the drive system of the friction wheel of the feeder of FIG. 1.

As seen in FIG. 4 of the drawings, drive shaft 28 of friction wheel 24 is driven from a stepping motor 60 through a reducing gear 62. Stepping motor 60 is connected electrically to a drive 64 which is controlled by a variable frequency oscillator 66 in known manner. A photoelectric cell and light beam unit 67 attached to frame 22 is located forward from belt 12 and friction wheel 24 in line with gap 50. Photoelectric unit 67 is connected electrically with a pulse count control device 68 which is in turn connected electrically with stepper motor drive 64 to gate the pulses received by the motor from variable frequency oscillator 66. In addition a direction control switch 69 is connected electrically to stepping motor drive 64 for rotating friction wheel 24 in either direction and also acts as an on-off switch.

Figure 2:
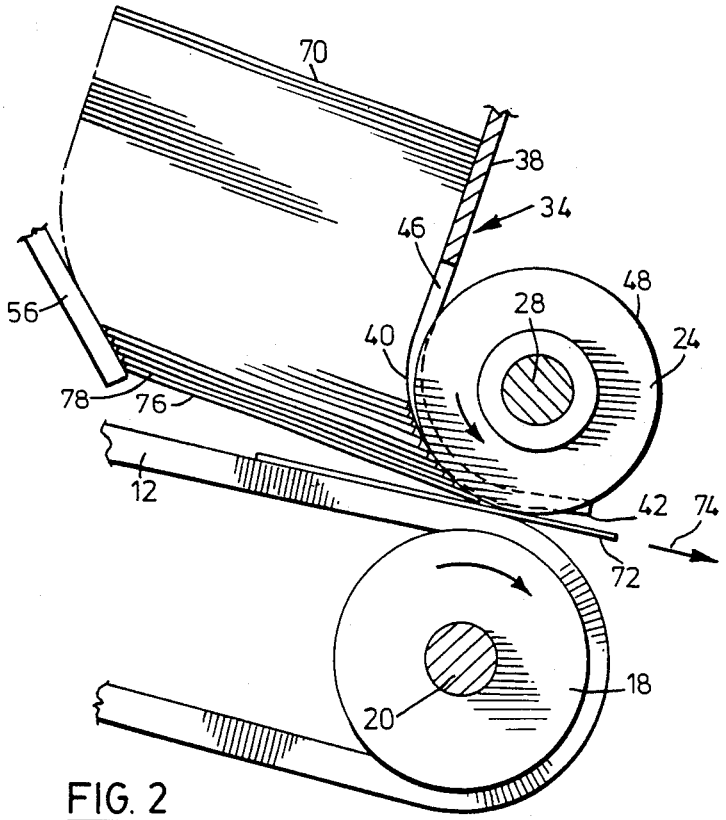
FIG. 2 is a side view of the lower portion of the card feeder of FIG. 1, carrying a stack of cards.
Figure 3:
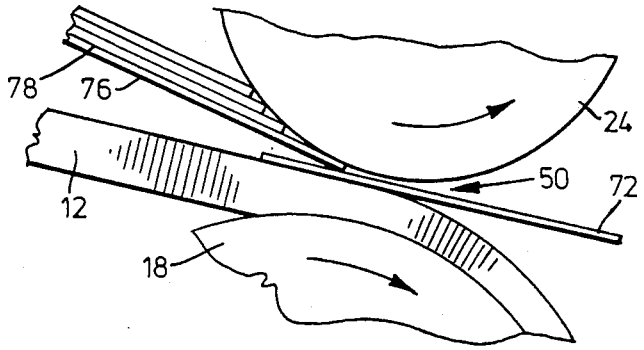
FIG. 3 is an enlarged view of part of the feeder of FIG. 2 showing a card being fed therethrough.

In the operation of the device, a stack 70 of cards is placed between guide bar 34 and retainer plate 56, as seen in FIG. 2, which hold the stack sloping downwardly in a forward direction with the lower cards of the stack being fanned forwardly. As the bottom or first card 72 in stack 70 moves downwardly, the leading edge of that card touches belt 12 and is pulled forward into gap 50 by the continuous movement of the belt in the direction of arrow 74 as seen in FIGS. 2 and 3. The forward movement of bottom card 72 allows the trailing edge of the card to clear the bottom edge of retainer plate 56 and drop onto belt 12. Gap 50 is adjustable to be of a width sufficient only to pass a single card 72 freely.

As the leading edge of bottom card 72 passes into gap 50 the leading edge of the card immediately above it, namely second card 76 and third card 78, are forced forwardly by the weight of the stack and the slope of retainer plate 56, aided by the friction created as bottom card 72 is pulled from stack 70. At this point the leading edge of card 76 comes into contact with friction wheel 24 which is geared to rotate at an extremely slow speed, say 1:3,000 in relation to the speed of belt 12, and the friction wheel draws card 76 further forward into a position where its leading edge is against bottom card 72 and closer to gap 50. Bottom card 72 continues to be carried forward by belt 12 through gap 50 and then passes through photoelectric unit 67. When card 72 has passed through gap 50 the leading edge of the next card 76 drops onto belt 12 and is carried forward, causing the trailing edge of card 76 to clear retainer plate 56 whereupon card 76 passes through gap 50 and photoelectric unit 67 in the same manner as preceding card 72.

The rotation of friction wheel 24 is controlled by phoeoelectric unit 67. When a card passes from feeder 10 through photoelectric unit 67 the interrupted beam triggers pulse counter 68 which may be preset to a given count, usually calibrated from 1 to 9. Pulse counter 68 permits a preselected count of pulses, transmitted from oscillator 66, to be received by motor drive 64, causing stepping motor 60 to rotate friction wheel 24 through a predetermined arc and allowing the next card in stack 70 to pass through gap 50 in feeder 10. In other words, stepping motor 60 is operated electrically to index one step per pulse received from oscillator 66 and the indexed movement of the stepping motor is translated through reducing gear 62 to rotate friction wheel 24 a predetermined amount, allowing the controlled advancement of the cards from stack 70. For example, if each pulse from oscillator 66 rotates stepper motor 60 through an arc of $7\frac{1}{2}°$ and there is a 25:1 reduction through reducing gear 62 and the diameter of friction wheel 24 is 2", then the surface of the friction wheel will move about 0.015" per pulse. If it is desired to move friction wheel 0.030" to obtain a smooth feed of cards from stack 70 and have the cards evenly spaced apart a predetermined amount then counter 68 is set to allow two pulses to pass from oscillator 66 to motor drive 64 each time a card passes through photoelectric cell 67.

On the other hand to obtain a batch of five cards a movement of 0.060" of friction wheel 24 may be required which would call for four pulses per batch, each batch (rather than each individual card) actuating photoelectric cell 67.

The arcuate movement of friction wheel 24 is determined by the thickness and/or texture of the cards of stack 70 and counter 68 is preset accordingly. Usually it is necessary to make a trial run to arrive at the correct setting for pulse counter 68, i.e. that setting which will feed cards from stack 70 evenly and with the predetermined optimum spacing between each card issuing from feeder 10. By rotating friction wheel 24 intermittently by spaced pulse counts (i.e. groups of pulses in spaced sequence) and by using an appropriate reducing gear 62, the same control is achieved as would be obtained were it possible to provide an infinitely variable drive motor for the friction wheel. If it is desired to rotate friction wheel 24 continuously, usually for thicker stock, pulse counter 68 is provided with a setting to permit such continuous pulsed rotation.

It will be appreciated that the term "card" is meant to include any flexible sheet material, suitable for feeding by the device of the invention, irrespective of relative thickness or stiffness.

In the alternate embodiment shown in FIGS. 5 to 8 of the drawings single friction wheel 24 is replaced by a stack advancer 80, movable platform belt 12 is replaced by a multiple feeder platform 82, and an auxiliary feeder 84 replaces retainer plate 56. A chute 86 may be positioned adjacent the nip between stack advancer 80 and feeder platform 82, such a chute being useful also in the previous embodiment.

Figures 6, 7:
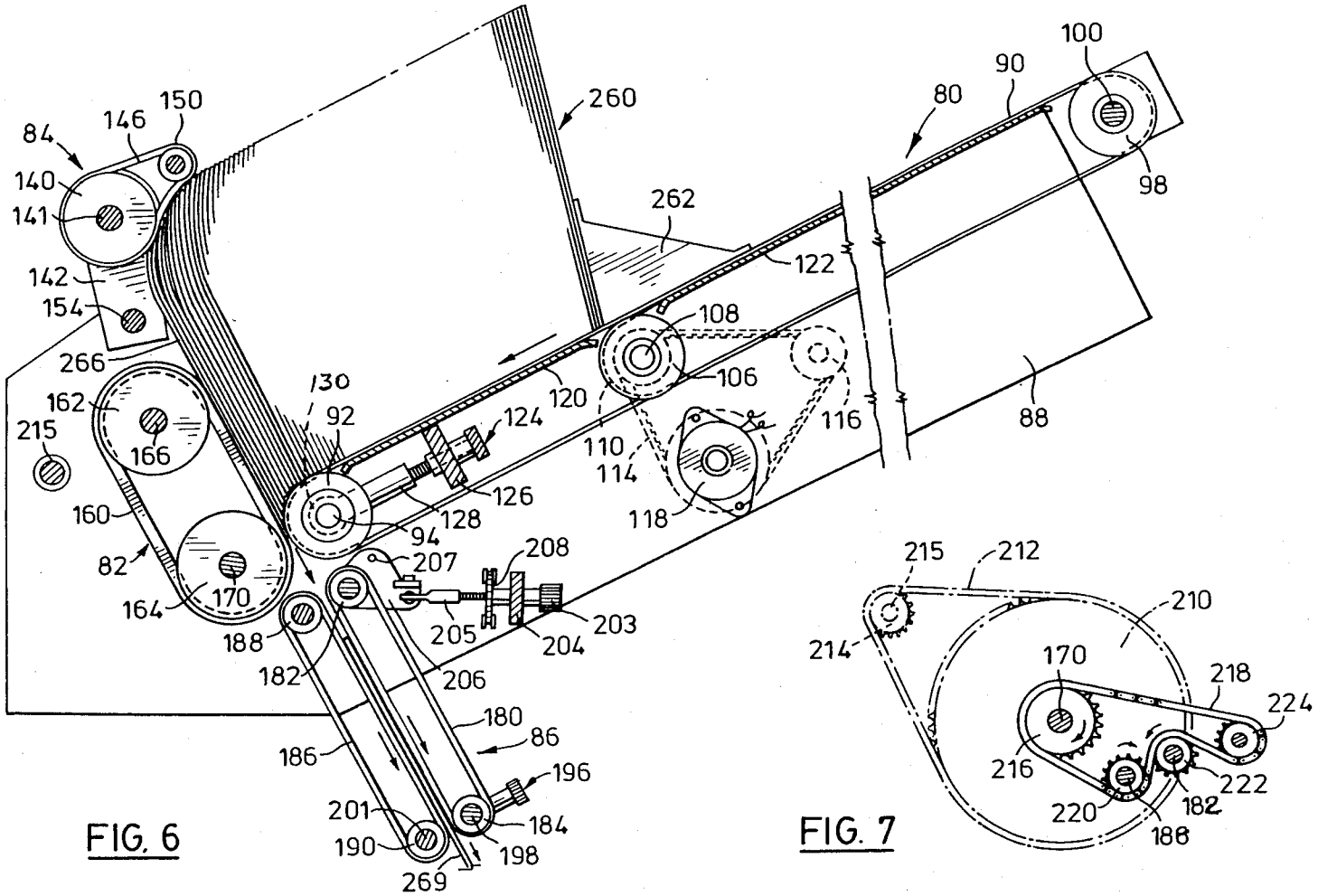
FIG. 6 is a cross-sectional view taken along line 6—6 of FIG. 5 with the stack advance mechanism carrying a stack of cards.
FIG. 7 is a side view of the chain drive for the movable platform of FIG. 5.
Figure 10:
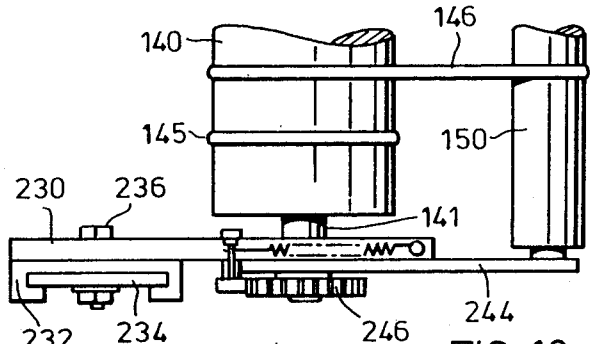
FIG. 10 is a plan view of the adjustment device of FIG. 9.
Figure 9:
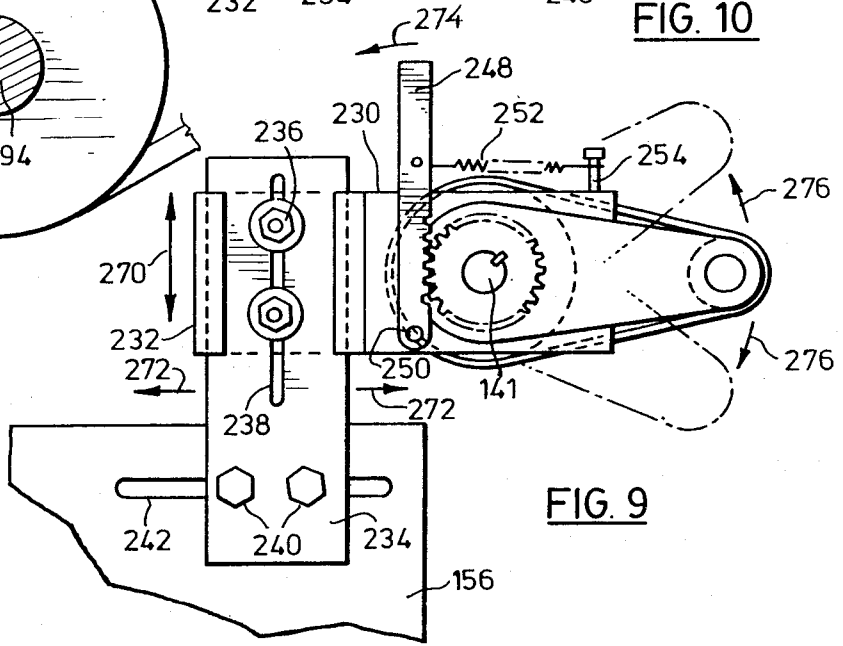
FIG. 9 is a side elevational view of an alternate embodiment showing an adjustment device for the auxiliary feeder.

Stack advancer 80 comprises a frame 88 carrying a pair of parallel endless belts 90 which engage a pair of idler wheels 92 journally mounted on a shaft 94 axially rotatable in journals 95 which are slidable in slots 96 in frame 88 adjacent platform 82. At the other end of frame 88, belts 90 engage a pair of pulleys 98 keyed on a shaft 100 which is journally mounted on a pair of slotted brackets 102 fixed by bolts 104 to frame 88 for slidable adjustment. A further pair of pulleys 106 are keyed on a drive shaft 108 which is journally mounted on frame 88 between shafts 94 and 100. Pulleys 106 engage a further pair of endless belts 110 which lie parallel to belts 90 and engage further pulleys 112 keyed on shaft 100. As seen in FIG. 6, drive shaft 108 is connected by a belt 114 with a tensioning pulley 116 and a stepping motor 118. Plates 120 and 122 are fixed to frame 88 to support the upper run of belts 90 and 110. A pair of adjustment screws 124 are mounted on a crossbar 126 which is fixed to frame 88 and engage bosses 128 on journals 130 of shaft 94. Adjustment screws 124 rotate freely in crossbar 126 but cannot move axially in the crossbar. Shaft 94 is driven by a stepping motor 132 slidably mounted by bolts 134 on a slotted bracket 136 on frame 88. A pair of friction wheels 138 are keyed on shaft 94 for rotation by stepping motor 132.

Auxiliary feeder 84 comprises a drum 140 having an axle 141 journally mounted on a frame 142 and driven by a stepping motor 144 which is also mounted on frame 142. Drum 140 circumferential ribs 145 adjacent each end of the drum and carries a pair of parallel endless bands 146 which also engage a pair of idler pulleys 148 journally mounted on a shaft 150. Shaft 150 is slidably mounted for lateral adjustment on a pair of slotted brackets 152 fixed to frame 142. Frame 142 is mounted for free rotation on a shaft 154 which is parallel to the axis of drum 140 and fixed to an extension 156 or frame 88. A screw 158 mounted on frame extension 156 selectively engages a ring of apertures 160 in frame 142 concentric with shaft 154.

Feeder platform 82 comprises a plurality of parallel endless belts 160 passing around an upper set of pulleys 162 and a lower set of pulleys 164. Upper pulleys 162 are journalled on a shaft 166 the ends of which are slidable laterally in slots 168 in extension 156 of frame 88. Lower pulleys 164 are keyed on a shaft 170 which is journally mounted in extension 156. A tension adjustment screw 172 on each end of shaft 166 moves the end of that shaft laterally in slot 168.

Chute 86 comprises (1) an upper set of parallel bands 180 engaging an upper grooved roller 182 and a lower grooved roller 184 which are journally mounted on frame 88 and (2) a lower set of parallel bands 186 engaging an upper grooved roller 188 and a lower grooved roller 190 which are journally mounted on a bracket 194 fixed to the frame. For adjustment of the gap between bands 180 and 186 a pair of adjustment screws 196 are thread-mounted on the ends of shaft 198 of roller 184 which are slidable laterally in slots 200 in brackets 194. The ends of adjustment screws 196 engage the ends of shaft 201 or roller 190.

A compression spring 202 on each screw 196 urges shafts 198 and 201 apart. For the further adjustment of the gap between bands 180 and 186 a pair of adjustment screws 203 are mounted on a further crossbar 204 fixed to frame 88, the screws being freely rotatable but nonmovable axially in the crossbar. Each screw 203 engages a boss 205 which pivotally engages an arm 206 pivotally mounted on a pin 207 fixed on frame 88 and pivotally engaging shaft 188 of roller 182 of upper bands 180. An endless chain 208 engges both adjustment screws 203 to provide a uniform adjustment of each end of roller 182.

Figure 5:
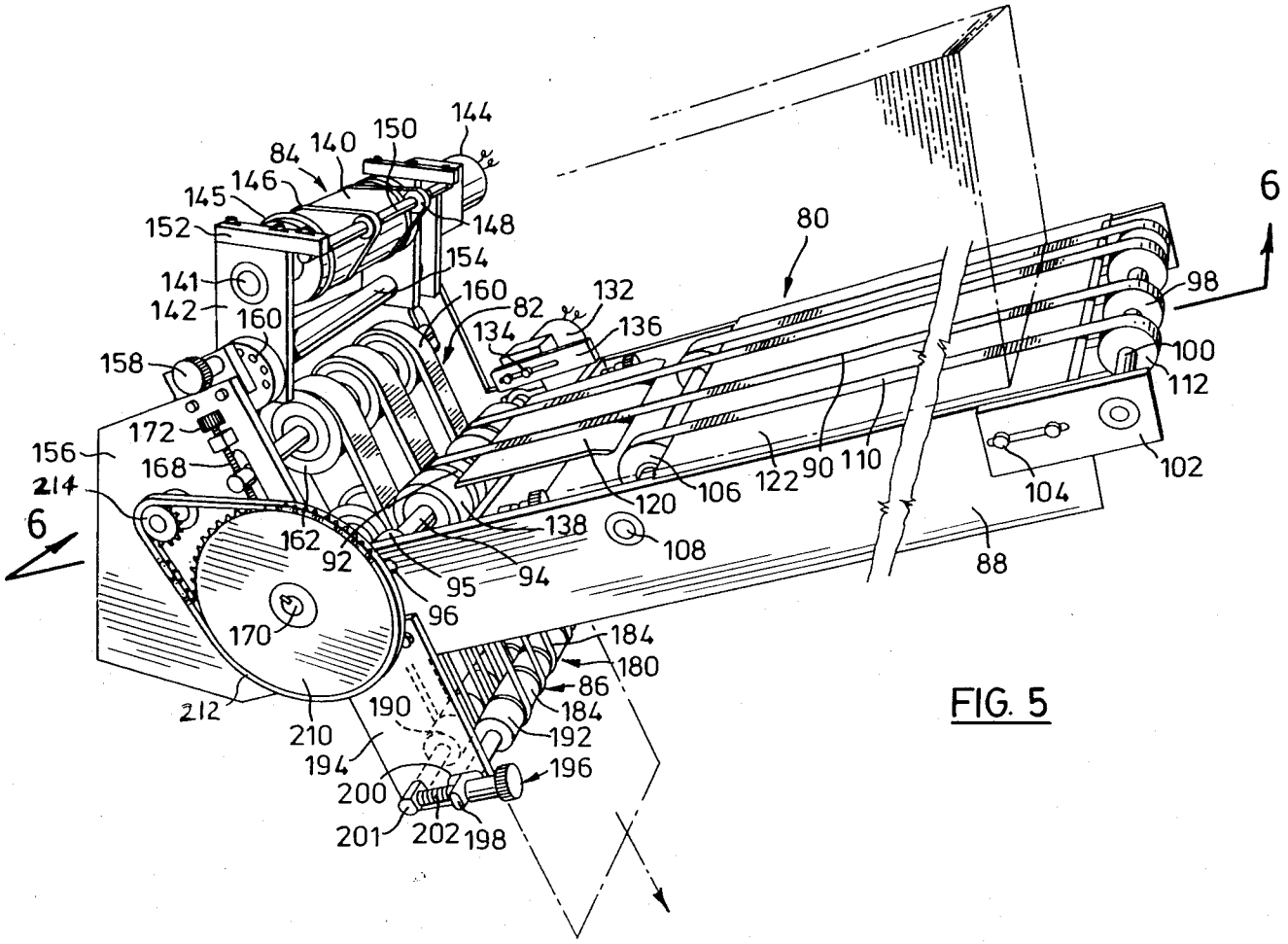
FIG. 5 is a perspective view of an alternate embodiment of a card feeder with a stack advance mechanism and an auxiliary feed mechanism.

As seen in FIGS. 5 and 7, a large diameter sprocket 210 is keyed on the end of lower shaft 170 of platform 82 and is connected by a chain 212 to a drive sprocket 214 driven by a variable speed direct current motor (not shown) through a drive shaft 215. A further sprocket 216 is also keyed to lower shaft 170 and is connected by a chain 218 to sprockets 220 and 222 keyed on upper rollers 182 and 188 respectively of chute 86. Chain 218 also engages an idler sprocket 224.

As seen in FIGS. 5 and 6, delivery platform 80 slopes downwardly in one direction at a shallow incline towards feeder platform 82 while the feeder platform slopes downwardly in the other direction at a steep incline, the planes of the two platforms being approximately normal one to the other. A gap 264 is formed between belts 160 of feeder 82 and friction wheels 138 of delivery platform 80.

In the operation of the embodiment shown in FIGS. 5 to 8 of the drawings a stack 260 of cards is placed on advancer 80 to bear against delivery platform 82, with a sliding prop 262 resting on belts 90 and 110 and bearing against the rear of the stack to keep it compact.

Figure 8:
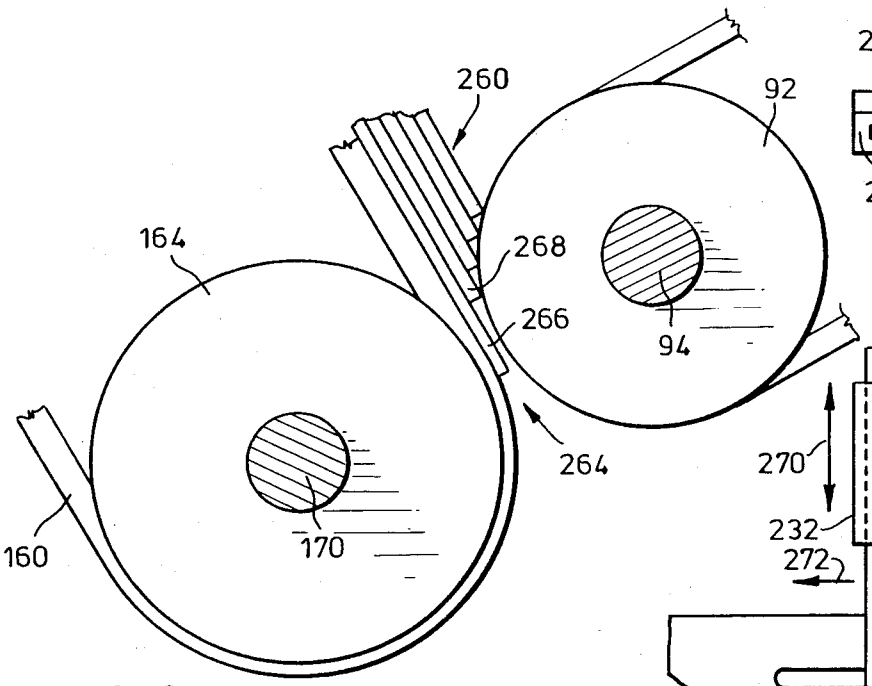
FIG. 8 is a fragmentary side view of the nip between the movable platform and the friction wheel drive showing an individual card being fed through the nip.

As seen in FIG. 6, the upper edges of the individual cards adjacent delivery platform 82 (the lower cards) bear against bands 146 of auxiliary feeder 84 which fans the cards downwardly (forwardly) as described in the previous embodiment, the foremost (lowest) card being pulled into gap 264 as seen in FIG. 8. In this embodiment, however, auxiliary feeder 84 is pulsed together with friction wheels 138 (by stepping motor 132) but each pulse of the auxiliary feeder is of longer duration than the pulse of the friction wheel. In this way the lower cards of stack 260 are pushed towards 264, the bottom card 266 passing freely through the gap while the second lowest card 268 is drawn forward as previously described. In this manner auxiliary feeder 84 overcomes the excessive friction between the individual cards caused by the weight of the stack.

Advancer 80 is pulsed by stepping motor 118 to urge stack 260 against platform 82 with a substantially constant pressure, operating when the bottom card 266 of the stack has been pulled into gap 264. Friction wheels 138 are pulsed by stepping motor 132 in the manner described in the previous embodiment of FIGS. 1 to 4.

When bottom card 266 passes through gap 264 it enters chute 86 as seen in FIG. 6 which shows an individual card 269 being delivered by the chute to a further apparatus such as a collator (not shown).

The embodiment of FIGS. 5 to 8 provides a consistent feed from a stack of individual cards of thicker card material, achieving a much higher consistent feed rate than in conventional machines.

I claim:

1. In a method of feeding cards or like paper stock singly from a stack thereof, using a friction wheel positioned above a movable platform to feed the cards singly from the bottom of the stack forwardly onto the platform from the stack and to pass the cards singly through a gap between the friction wheel and the platform to issue therefrom, the step of:

rotating the friction wheel sequentially through preselectable arcs whereby the issuing cards are optimally spaced apart.

2. A method as claimed in claim 1 in which the friction wheel is rotated intermittently at preselectable intervals.

3. A method as claimed in claim 2 in which the rotation of the friction wheel is actuated by the passage of each issuing card.

4. A method as claimed in claim 3 in which the friction wheel is driven by a stepping motor having drive means electrically motivated by a variable frequency oscillator, the issuance of each card actuating pulse count control means connected electrically with the drive means to gate the pulses received from the oscillator.

5. In a method as claimed in claim 1, in which a stack advancer is used to move the stack towards the movable platform the additional step of:

moving the stack advancer sequentially a preselectable amount whereby the pressure of the stack against the movable platform is substantially constant.

6. A method as claimed in claim 5 in which the stack advancer is moved intermittently.

7. In a method as claimed in claim 1, including the step of using an auxiliary feeder to assist in feeding the cards singly into the gap between the friction wheel and the platform, the auxiliary feeder being moved sequentially a preselectable amount.

8. A method as claimed in claim 7 in which the auxiliary feeder is moved intermittently.

9. In a device for feeding cards and like paper stock singly from a stack thereof, in which a friction wheel is positioned above a movable platform and the cards are fed singly from the bottom of the stack through a gap between the friction wheel and the platform to issue therefrom:

a stepping motor connected to drive the friction wheel; and means connected with the stepping motor to control the rotation of the friction wheel sequentially through preselectable arcs whereby the issuing cards are optimally spaced apart.

10. A device as claimed in claim 9 in which the stepping motor includes drive means and a variable frequency oscillator motivating the drive means, the control means comprising pulse count control means connected electrically with the drive means whereby the friction wheel is driven intermittently at preselected intervals.

11. A device as claimed in claim 10 including a photoelectric unit positioned for actuation by each issuing card and connected electrically with the pulse count control means.

12. A device as claimed in claim 9 including a stack advancer to move the stack towards the movable platform, the stack advancer comprising a plurality of parallel movable endless belts and a stepping motor connected to drive the belts, means being connected to the stepping motor to control the advancement and operation thereof.

13. A device as claimed in claim 9 including an auxiliary feeder to assist in feeding the cards singly into the gap between the friction wheel and the platform, the auxiliary feeder comprising a plurality of parallel movable endless bands constructed and arranged to bear transversely against the bottom edge portion of the stack remote from the friction wheel, a stepping motor connected to drive the bands, and means connected to the stepping motor to control the advancement and operation thereof.

14. A device as claimed in claim 13 including means to vary the angle of the bands in relation to said bottom edge of the stack.

* * * * *